US005694000A

United States Patent [19]

Antonis et al.

[11] Patent Number: 5,694,000

[45] Date of Patent: Dec. 2, 1997

[54] ELECTRODELESS LOW-PRESSURE DISCHARGE LAMP, AND LIGHTING UNIT PROVIDED WITH SUCH A LAMP

[75] Inventors: Petrus H. Antonis; Klaas Vegter, both of Eindhoven, Netherlands

[73] Assignee: U.S. Philips Corporation, New York, N.Y.

[21] Appl. No.: 576,549

[22] Filed: Dec. 21, 1995

[30] Foreign Application Priority Data

Dec. 23, 1994 [EP] European Pat. Off. ..... 94203744

[51] Int. Cl.[6] ..... H01J 65/04

[52] U.S. Cl. ..... 313/234; 313/607

[58] Field of Search ..... 313/234, 607; 315/248, 344, 236, 242

[56] References Cited

U.S. PATENT DOCUMENTS 4,240,010 12/1980 Buhrer ..... 315/248

4,977,354 12/1990 Bergervoet et al. ..... 315/248

*Primary Examiner*—Nimeshkumar Patel

*Attorney, Agent, or Firm*—Walter M. Egbert

[57] ABSTRACT

An electrodeless low-pressure discharge lamp (10) according to the invention is provided with a radiation-transmitting discharge vessel (11) which encloses a discharge space (14) containing an ionizable filling in a gastight manner. The lamp (10) is in addition provided with a first and a second winding (20, 23) for conducting a high-frequency current during operation. The first winding (20) extends along a longitudinal axis (29) in a cavity (28) surrounded by the discharge vessel (11). The second winding (23) is arranged along the longitudinal axis (29) in the extended direction of the first winding (20) outside the cavity (18) surrounded by the discharge vessel (11). During operation, the currents in the first and second windings (20, 23) have the same tangential direction relative to the longitudinal axis (29). The lamp causes comparatively little magnetic interference, while it is avoided that the second winding (23) hampers lamp ignition or causes an unstable lamp operation.

8 Claims, 2 Drawing Sheets

ELECTRODELESS LOW-PRESSURE DISCHARGE LAMP, AND LIGHTING UNIT PROVIDED WITH SUCH A LAMP

BACKGROUND OF THE INVENTION

The invention relates to an electrodeless low-pressure discharge lamp provided with a radiation-transmitting discharge vessel which encloses a discharge space containing an ionizable filling in a gastight manner and further provided with a first and a second winding for conducting a high-frequency current during operation, said first winding extending along a longitudinal axis in a cavity surrounded by the discharge vessel and said second winding being arranged along the longitudinal axis in the extension of the first winding.

The invention also relates to a lighting unit provided with such a lamp.

Such a lamp is known from U.S. Pat. No. 4,240,010. The discharge vessel in the known lamp has an inner and an outer cylindrical portion which are interconnected at either end via end portions. The discharge space of the lamp contains a filling of mercury and argon. The inner portion of the discharge vessel surrounds a cavity in which a first and a second winding are arranged in one another's extended direction. The current traversing the windings during operation generates a high-frequency magnetic field which maintains an electric discharge in the discharge space. The designation "high-frequency" in the present description and claims is understood to denote a frequency of at least 20 kHz. The current in the second winding has a tangential direction which is opposed to that in the first winding, so that the first and second windings compensate one another's magnetic dipole moments. It is achieved by this measure that the lamp causes comparatively little interference owing to high-frequency magnetic fields. A disadvantage is, however, that the measure may lead to ignition problems and to unstable lamp operation.

SUMMARY OF THE INVENTION

It is an object of the invention to provide a lamp of the kind mentioned in the opening paragraph which is of a construction in which said disadvantages are avoided.

According to the invention, the lamp is for this purpose characterized in that the second winding is positioned outside the cavity surrounded by the discharge vessel, and in that during operation the currents in the first and second windings have the same tangential direction relative to the longitudinal axis.

It was surprisingly found that the second winding results in a reduction in magnetic interference, which was not at all to be expected: since the tangential direction is the same in the first and second windings, the first and second windings in fact have magnetic dipole moments of the same direction. It was indeed found to be a necessary condition, however, that the second winding is positioned outside the cavity surrounded by the discharge vessel. The disadvantages in the known lamp were found not to be present in a lamp according to the invention.

The first winding may be positioned, for example, in the discharge space. An attractive embodiment of the lamp according to the invention is characterized in that the discharge vessel has an outer and an inner portion, the inner portion surrounding the cavity in which the first winding extends and separating said cavity from the discharge space. This embodiment of the lamp may be of a comparatively simple construction since additional measures for protecting the first winding from the conditions prevalent in the discharge are unnecessary, as are current lead-through conductors. The inner portion of the discharge vessel is formed, for example, by a recess. Alternatively, the discharge vessel may have the shape, for example, of a torus, for example, with an inner and an outer cylindrical wall.

The ionizable filling may comprise besides a rare gas, a metal vapour, for example sodium vapour. In an embodiment, the filling comprises, for example, mercury vapour and a rare gas. The discharge vessel of the lamp may be entirely or partly provided with an optically active layer such as a luminescent layer or a reflecting layer.

A favorable embodiment of the electrodeless low-pressure discharge lamp according to the invention is characterized in that the second winding surrounds a large surface area transverse to the longitudinal axis, as compared with the first winding. In this embodiment, a significant reduction in magnetic interference can be realized already with the second winding having a comparatively small number of turns, for example one half of a turn.

The lamp according to the invention may form part of a lighting unit which in addition comprises a supply unit. For example, the supply unit delivers a current with a frequency of a few MHz. The lamp can be connected to the supply unit, for example, via a coax cable. Alternatively, the supply may be accommodated, for example, in a housing fastened to the lamp, which housing in addition supports a lamp cap. Such a lighting unit may serve as a replacement for an incandescent lamp.

The discharge vessel may be, for example, detachable from the housing, so that it may be replaced if so desired, for example with a discharge vessel containing a different filling.

A favorable embodiment of the lighting unit comprising a low-pressure discharge lamp according to the invention is characterized in that the lighting unit in addition comprises a supply unit with a first output terminal which is free from high-frequency voltage variations relative to ground and with a second output terminal which has a voltage which varies with high frequency relative to ground, while the first and the second winding are connected in series with one another to the output terminals of the supply unit, the lighting unit being in addition provided with a third winding which has a free first end and a second end which is connected to the first output terminal of the supply, such that during operation a voltage difference is generated in the third winding between the first and the second end which is opposed to the voltage difference between the second and the first output terminal. A supply unit of the above (asymmetrical) type may have a comparatively favorable cost price compared with a symmetrical supply unit where the output terminals both supply voltages which vary relative to ground with high frequency and which have mutually opposed phases. The third winding counteracts interference by high-frequency electric fields which may be caused by the asymmetrical supply unit.

BRIEF DESCRIPTION OF THE DRAWINGS

These and other aspects of the invention will be explained in more detail with reference to the drawing, in which.

DETAILED DESCRIPTION OF THE INVENTION

Figure 1:
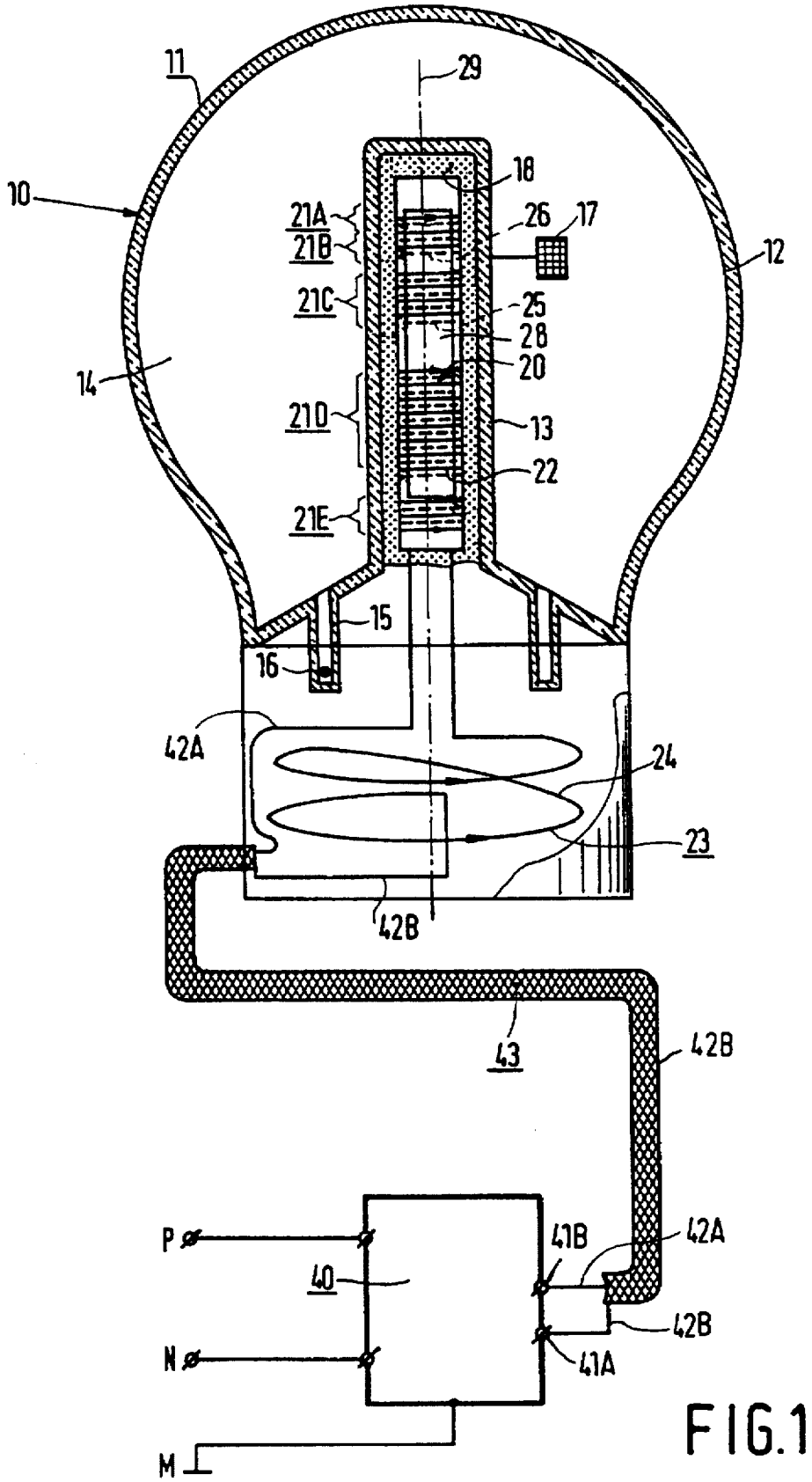
FIG. 1 shows an embodiment of a lighting unit provided with a lamp according to the invention partly in longitudinal sectional view, partly in elevation.

The lighting unit shown in FIG. 1 comprises an electrodeless low-pressure discharge lamp 10 according to the invention and a supply unit 40. The electrodeless low-pressure discharge lamp 10 is provided with a discharge vessel 11 which encloses a discharge space 14 in a gastight manner. The discharge space 14 contains an ionizable filling, here a filling of argon with a filling pressure of 33 Pa and mercury. A main amalgam 16 of 180 mg of the alloy $Bi_{56}In_{44}$ (in at%) with 5.5 mg mercury is arranged in an exhaust tube 15 which constitutes a comparatively cold spot during operation. The main amalgam 16 stabilizes the mercury vapour pressure prevailing in the discharge space 14 during operation to a value of approximately 0.5 Pa. An auxiliary amalgam 17 is in addition arranged in the discharge space 14. The discharge vessel 11 has a glass outer portion 12 which transmits visible radiation and an inner portion 13 in the form of a recess. The lamp 10 is in addition provided with a first and a second winding 20, 23 of copper wire of 0.25 mm thickness. The first winding 20 extends along a longitudinal axis 29 in a cavity 18 which is surrounded by the inner portion 13 of the discharge vessel 11 and separated from the discharge space 14. The first winding 20 has 19 turns with a diameter of 14 mm distributed over five segments 21A to 21E of 1, 2, 4, 9, and 3 turns 22, respectively. In the embodiment shown, the first winding 20 is provided around a rod-shaped core 28 of soft-magnetic material, here having a diameter of 12 mm and a length of 50 min. Alternatively, a core may be absent. The second winding 23, having two turns 24, is arranged along the longitudinal axis 29 in the extension of the first winding 20. A current with a frequency of 2.65 MHz traverses the first and second windings 20, 23 during operation.

The second winding 23 is positioned outside the cavity 18 surrounded by the discharge vessel 11. The distance from the second winding 23 to the plane in which the edge of the recess 13 and the outer portion 12 are present is approximately 20 mm. The distance from the second winding 23 to the first winding is approximately 40 mm. During operation, the current in the second winding 23 has the same tangential direction as that in the first. The turn 24 of the second winding 23 have a diameter of 40 mm, so that the second winding 23 surrounds a large surface area transverse to the longitudinal axis 29 as compared with the first winding 20. The turns 24 of the second winding 23 are drawn at a comparatively large distance from one another in FIG. 1 for the sake of clarity. In actual fact, the pitch of the second winding 23 is approximately 1 mm.

An instantaneous current direction is indicated with arrows in turns 24 of the second winding 23 and in a few turns 22 of the first winding 20.

Furthermore, a third winding 25 (broken line in FIG. 1) is provided around the core 28, turns 26 thereof lying each against a turn 22 of the first winding 20. For greater clarity, only those portions of the turns of the first and third windings 20, 25 which face the plane of the drawing are shown.

Figure 2:
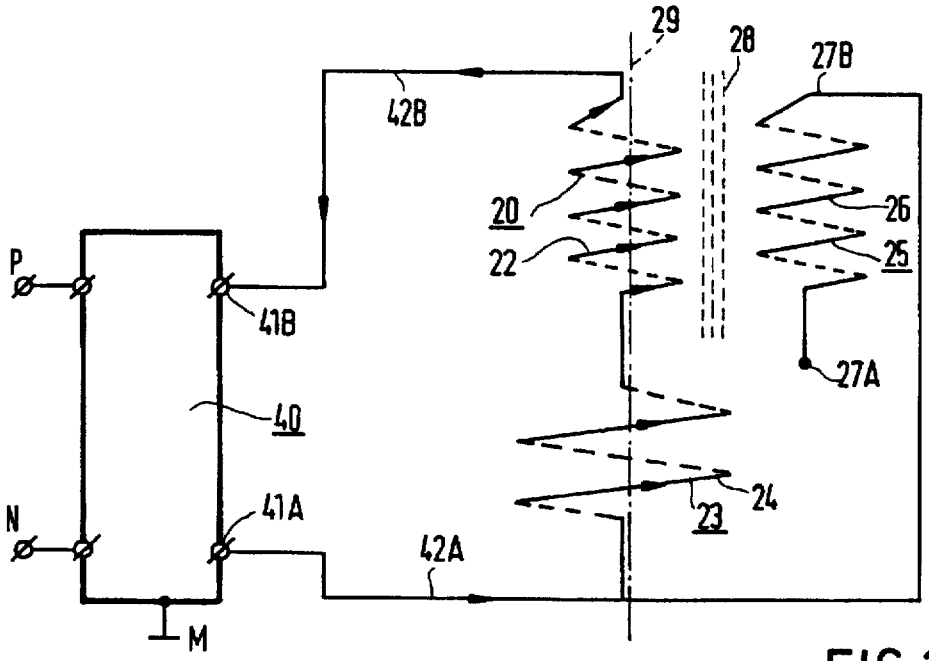
FIG. 2 is a diagram in which the interconnections between components of the lighting unit of FIG. 1 are depicted.

In the diagram of FIG. 2, the core 28 and the third winding 25 are shifted relative to the longitudinal axis 29 for greater clarity, while only a few turns of the first and third windings 20, 25 are shown. The instantaneous current direction mentioned above is again indicated with arrows, as in FIG. 1. The portions of the turns facing away from the plane of the drawing are indicated with broken lines in this Figure.

The supply unit 40 of the lighting unit shown in FIGS. 1 and 2 has a first output terminal 41A which is free from high-frequency voltage variations relative to ground M and a second output terminal 41B which supplies a voltage which varies with high frequency relative to ground M. The first and second windings 20, 23 are connected in series with one another to the output terminals 41A, 41B of the supply unit 40. The third winding 25 has a free first end 27A and a second end 27B which is connected to the first output terminal 41A of the supply unit 40. A first and a second current supply conductor 42A, 42B forming a sheath and a core of a coax cable 43, respectively, connect the output terminals 41B, 41A of the supply unit 40 to the windings 20, 23, 25. During operation, a voltage difference is induced in the third winding 25 between the first and second ends 27A, 27B which is opposed to the voltage difference obtaining between the second and first output terminals 41B, 41A. The supply unit 40 is connected to contacts P, N of the mains.

Lamps A, B, C and D were manufactured for investigating the effect of the second winding. The lamps all have a filling of exclusively argon with a filling pressure of 33 Pa so that influences of mercury vapour pressure variations are excluded during the measurements. Lamp A according to the invention corresponds to the embodiment described with reference to FIG. 1, apart from the nature of the filling. In lamp B, also according to the invention, the second winding has one turn. Lamp C, not according to the invention, lacks a second winding and lamp D, again not according to the invention, is provided with a single second turn in which the current has a tangential direction during operation which is opposed to that in the first winding. In other respects, there are no differences between the lamps of types A, B, C and D.

Figure 3:
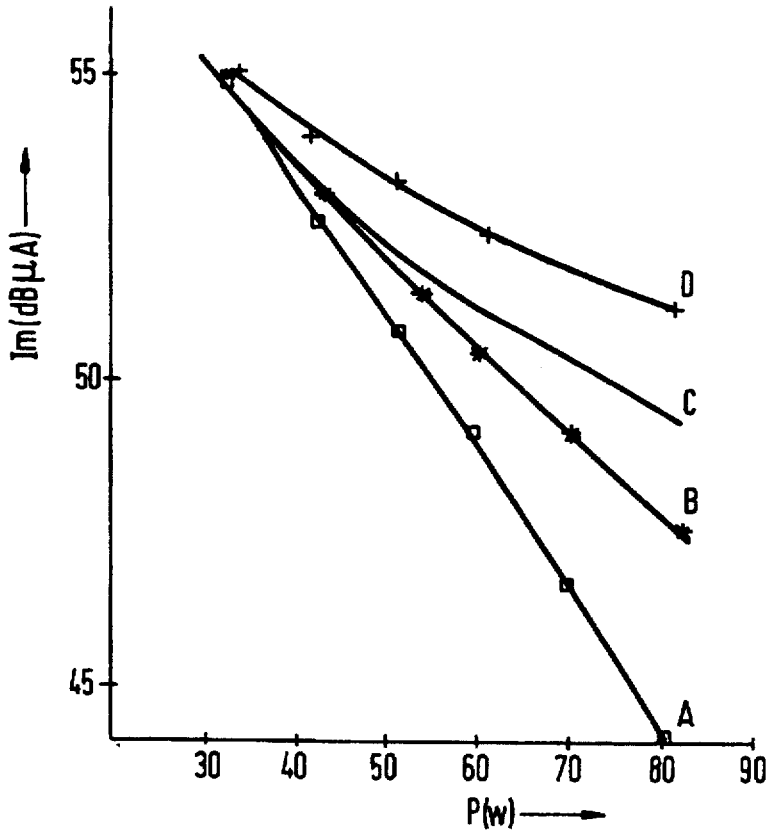
FIG. 3 shows the magnetic interference ($I_m$) of lamps according to the invention and of lamps not according to the invention as a function of the power (P) consumed by the lamp.

The axial component of the magnetic interference caused by lamps A to D was measured in accordance with standard EN 55015 for a lamp load ranging from 30 to 80 W. The other components of the magnetic field are negligibly small in comparison with the axial component. The magnetic interference value measured ($I_m$ in dBμA) is plotted in FIG. 3 as a function of the lamp power load (P in W). It is apparent from this Figure that the presence of the second winding in lamps (A, B) according to the invention, where the current in the second winding has the same tangential direction as in the first winding, considerably reduces interferences by high-frequency magnetic fields, especially at comparatively high lamp powers. In lamp D, where the current direction in the second winding is opposed to that in the first winding, the interference actually rises compared with lamp C without a second winding. The ignition behaviour of the lamps according to the invention (A, B) was comparable to that of lamps (C) lacking a second winding. The lamps according to the invention (A, B) showed a stable lamp operation.

Further electrodeless low-pressure discharge lamps were manufactured for comparison. The further lamps each have a coil with a first and a second winding which are both arranged in the cavity surrounded by the discharge vessel, while the current in the second winding has a tangential direction during operation opposed to that in the first winding. The first and second windings each surround their own core of soft-magnetic material. In other respects, these lamps correspond to lamps A to D. The ignition voltages of these lamps were approximately 50% higher than that of lamps according to the invention. The lamps showed an unstable lamp operation, in particular at comparatively low powers.

We claim:

1. An electrodeless low-pressure discharge lamp comprising a radiation-transmitting discharge vessel which encloses a discharge space containing an ionizable filling in a gastight manner, and further provided with a first and a second winding for conducting a high-frequency current during operation, said first winding extending along a longitudinal axis in a cavity surrounded by the discharge vessel and said second winding being arranged along the longitudinal axis in the extension of the first winding, characterized in that the second winding is positioned outside the cavity surrounded by the discharge vessel, and in that during operation the currents in the first and second windings have the same tangential direction relative to the longitudinal axis.

2. An electrodeless low-pressure discharge lamp as claimed in claim 1, characterized in that the discharge vessel has an outer and an inner portion, the inner portion surrounding the cavity in which the first winding extends and separating said cavity from the discharge space.

3. An electrodeless low-pressure discharge lamp as claimed in claim 2, characterized in that the second winding surrounds a large surface area transverse to the longitudinal axis, as compared with the first winding.

4. A lighting unit comprising a low-pressure discharge lamp as claimed in claim 3, characterized in that the lighting unit in addition comprises a supply unit with a first output terminal which is free from high-frequency voltage variations relative to ground and with a second output terminal which has a voltage which varies with high frequency relative to ground, while the first and the second winding are connected in series with one another to the output terminals of the supply unit, the lighting unit being in addition provided with a third winding which has a free first end and a second end which is connected to the first output terminal of the supply, such that during operation a voltage difference is generated in the third winding between the first and the second end which is opposed to the voltage difference between the second and the first output terminal.

5. A lighting unit comprising a low-pressure discharge lamp as claimed in claim 2, characterized in that the lighting unit in addition comprises a supply unit with a first output terminal which is free from high-frequency voltage variations relative to ground and with a second output terminal which has a voltage which varies with high frequency relative to ground, while the first and the second winding are connected in series with one another to the output terminals of the supply unit, the lighting unit being in addition provided with a third winding which has a free first end and a second end which is connected to the first output terminal of the supply, such that during operation a voltage difference is generated in the third winding between the first and the second end which is opposed to the voltage difference between the second and the first output terminal.

6. A lighting unit comprising a low-pressure discharge lamp as claimed in claim 1, characterized in that the lighting unit in addition comprises a supply unit with ah first output terminal which is free from high-frequency voltage variations relative to ground, while the first and the second winding are connected in series with one another to the output terminals of the supply unit the lighting unit being in addition provided with a third winding which has a free first end and a second end which is opposed to the voltage difference between the second and the first output terminal.

7. An electrodeless low-pressure discharge lamp as claimed in claim 1, characterized in that the second winding surrounds a large surface area transverse to the longitudinal axis, as compared with the first winding.

8. A lighting unit comprising a low-pressure discharge lamp as claimed in claim 7, characterized in that the lighting unit in addition comprises a supply unit with a first output terminal which is free from high-frequency voltage variations relative to ground and with a second output terminal which has a voltage which varies with high frequency relative to ground, while the first and the second winding are connected in series with one another to the output terminals of the supply unit, the lighting unit being in addition provided with a third winding which has a free first end and a second end which is connected to the first output terminal of the supply, such that during operation a voltage difference is generated in the third winding between the first and the second end which is opposed to the voltage difference between the second and the first output terminal.

* * * * *